US011296452B2

(12) United States Patent
Yamanashi

(10) Patent No.: US 11,296,452 B2
(45) Date of Patent: Apr. 5, 2022

(54) CONNECTOR WITH HOLDER THAT LOCKS COVER MEMBER

(71) Applicant: Yazaki Corporation, Tokyo (JP)

(72) Inventor: Daisuke Yamanashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 96 days.

(21) Appl. No.: 16/782,004

(22) Filed: Feb. 4, 2020

(65) Prior Publication Data

US 2020/0259288 A1 Aug. 13, 2020

(30) Foreign Application Priority Data

Feb. 8, 2019 (JP) ..... JP2019-021134

(51) Int. Cl.
*H01R 13/447* (2006.01)
*H01R 13/52* (2006.01)

(52) U.S. Cl.
CPC ..... *H01R 13/447* (2013.01); *H01R 13/52* (2013.01); *H01R 13/5202* (2013.01)

(58) Field of Classification Search
CPC ..... H01R 13/447; H01R 2103/00; H01R 13/512; H01R 13/4364; H01R 13/44; H01R 13/40; H01R 13/502; H01R 13/5202
See application file for complete search history.

(56) References Cited

U.S. PATENT DOCUMENTS 4,148,545 A * 4/1979 Kies ..... H01R 13/40 439/678
8,956,192 B2 * 2/2015 Eckel ..... H01R 13/641 439/686
9,153,901 B2 * 10/2015 Yamashita ..... H01R 13/533
9,455,523 B1 * 9/2016 Sundarakrishnamachari ..... H01R 13/62927
10,116,078 B1 * 10/2018 Durse ..... H01R 13/5208
2013/0052880 A1 * 2/2013 Wu ..... H01R 13/627 439/660
2017/0310036 A1 10/2017 Ono
2018/0358731 A1 * 12/2018 Endo ..... H01R 13/502

FOREIGN PATENT DOCUMENTS

JP 2017-199497 A 11/2017

* cited by examiner

*Primary Examiner* — Michael C Zarroli
(74) *Attorney, Agent, or Firm* — Kenealy Vaidya LLP

(57) ABSTRACT

A connector includes a housing that has an opening fitting with a mating connector, a plate-shaped terminal that is housed and held in the housing with a first side surface of the terminal facing the opening, an insulating cover member that is mounted on the terminal and covers the first side surface, and a holder that has through-holes into which mating terminals as terminals of the mating connector are inserted, is attached to the housing from the opening side, and locks the cover member.

8 Claims, 10 Drawing Sheets

CONNECTOR WITH HOLDER THAT LOCKS COVER MEMBER

CROSS-REFERENCE TO RELATED APPLICATION(S)

The present application claims priority to and incorporates by reference the entire contents of Japanese Patent Application No. 2019-021134 filed in Japan on Feb. 8, 2019.

BACKGROUND OF THE INVENTION

1. Field of the Invention

The present invention relates to a connector.

2. Description of the Related Art

In the related art, there is a connector provided with a contact prevention mechanism. Japanese Patent Application Laid-open No. 2017-199497 discloses a technique of a power connector having a power terminal and a housing that supports the power terminal. In the power connector in Japanese Patent Application Laid-open No. 2017-199497, the housing includes at least two adjacent insertion ports, each of which is partitioned by a partitioning member and through which a conductive member is inserted, and a housing space communicating with the insertion ports. The power terminal includes a contact portion which is disposed in the housing space and is contactable with the conductive member inserted through the at least two adjacent insertion ports. The contact portion is disposed to extend across the at least two adjacent insertion ports. According to the power connector of Japanese Patent Application Laid-open No. 2017-199497, there is little risk that a finger or the like touches the terminal even when the terminal is large, and it is not necessary to provide an insulating member for each open end.

There is still room for improvement in suppressing contact of a finger with respect to the terminal. For example, in order to suppress contact of a finger, it is conceivable to mount a cover member, which covers the terminal, on the terminal. Here, if the position of the cover member is shifted, the function of suppressing contact is reduced.

SUMMARY OF THE INVENTION

An object of the invention is to provide a connector which can suppress suitably contact of a finger with respect to a terminal.

In order to achieve the above mentioned object, a connector according to one aspect of the present invention includes a housing that has an opening fitting with a mating connector; a plate-shaped terminal that is housed and held in the housing with a first side surface of the terminal facing the opening; an insulating cover member that is mounted on the terminal and covers the first side surface; and a holder that has through-holes into which mating terminals as terminals of the mating connector are inserted, is attached to the housing from the opening side, and locks the cover member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a connector according to an embodiment of the invention will be described in detail with reference to the drawings. In addition, the invention is not limited by the embodiment. In addition, constituent elements in the following embodiments include those that can be easily assumed by those skilled in the art or those that are substantially the same.

Embodiment

Figure 1:
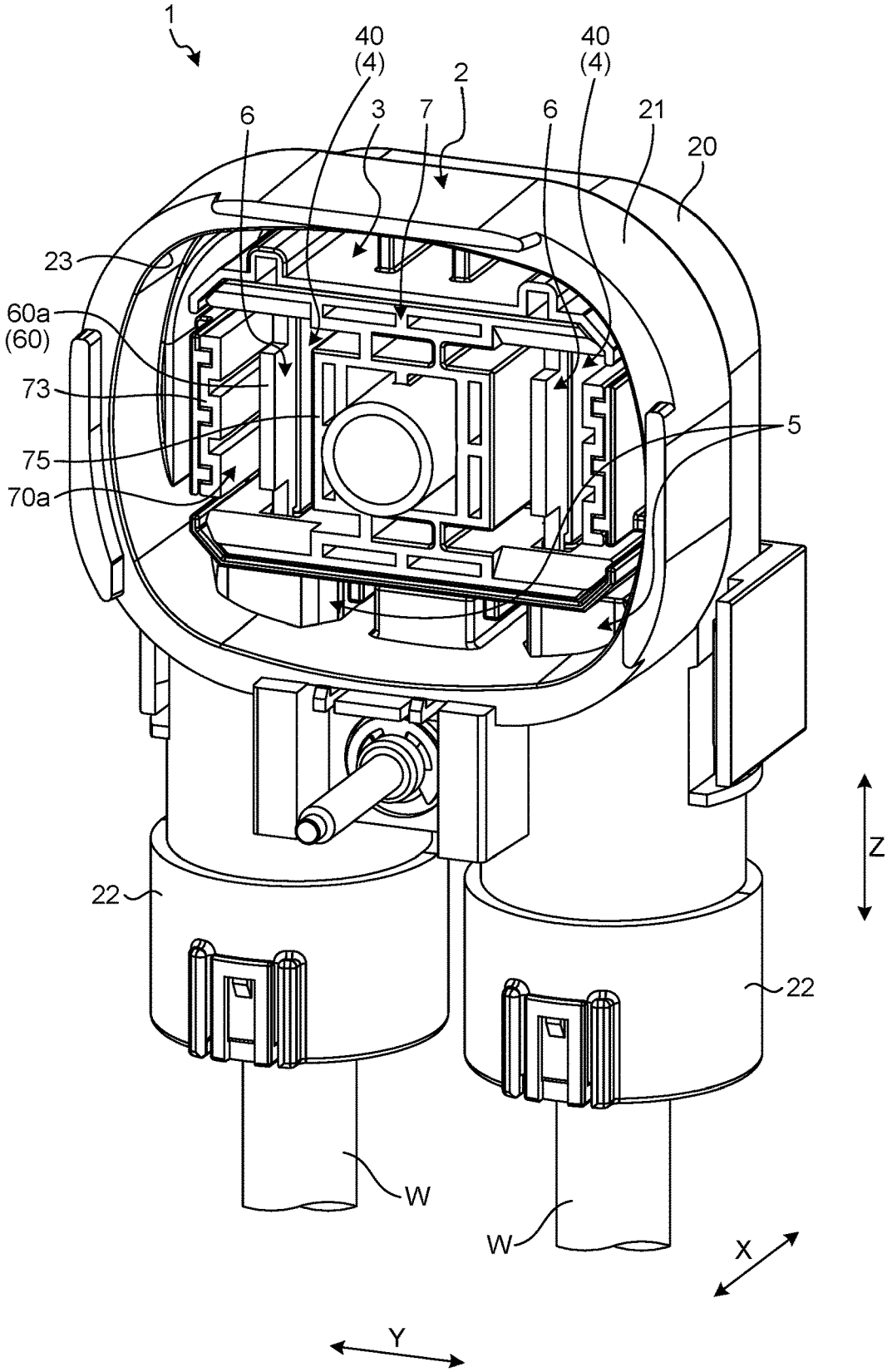
FIG. 1 is a perspective view of a connector according to an embodiment.
Figure 2:
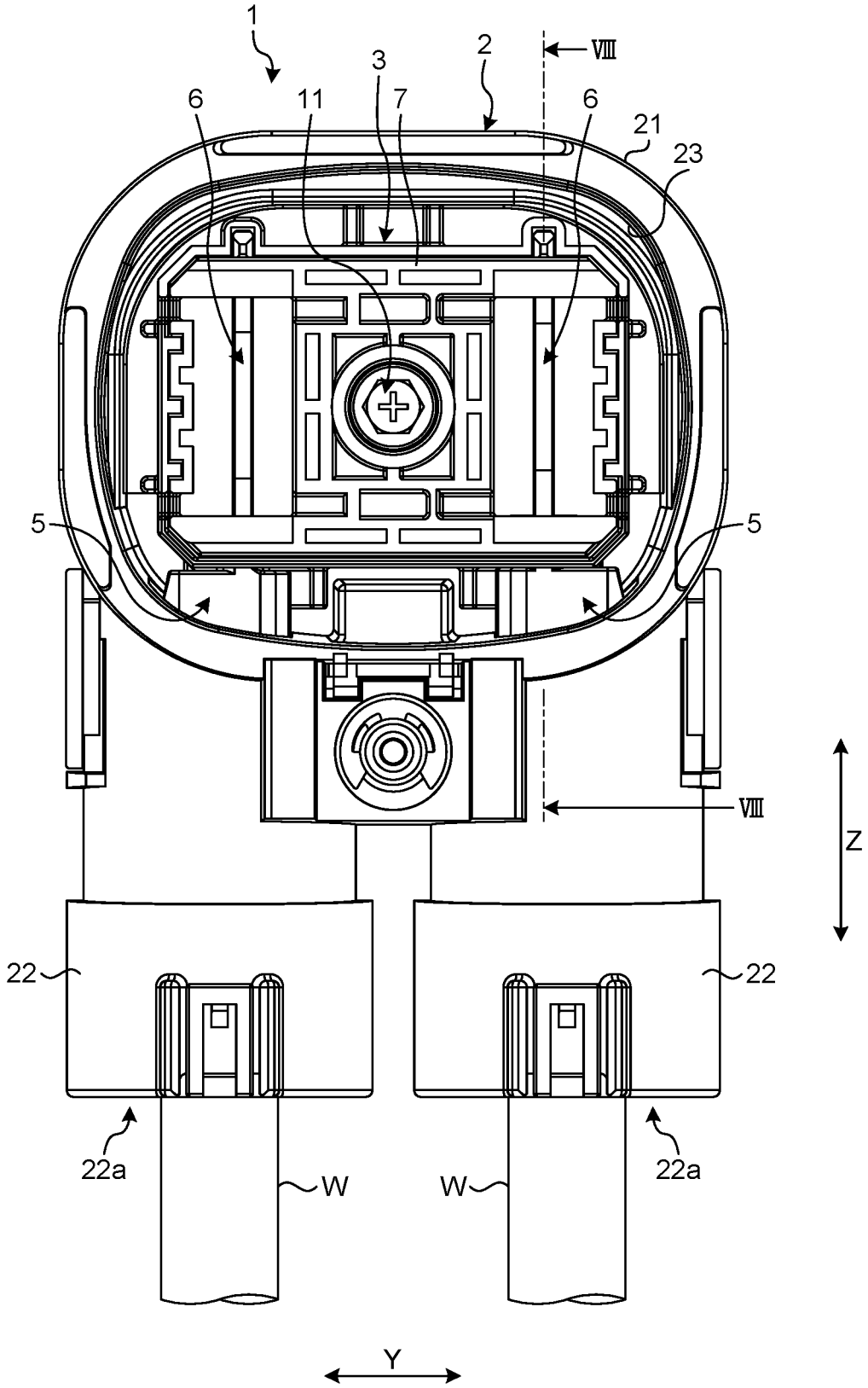
FIG. 2 is a front view of the connector according to the embodiment.
Figure 3:
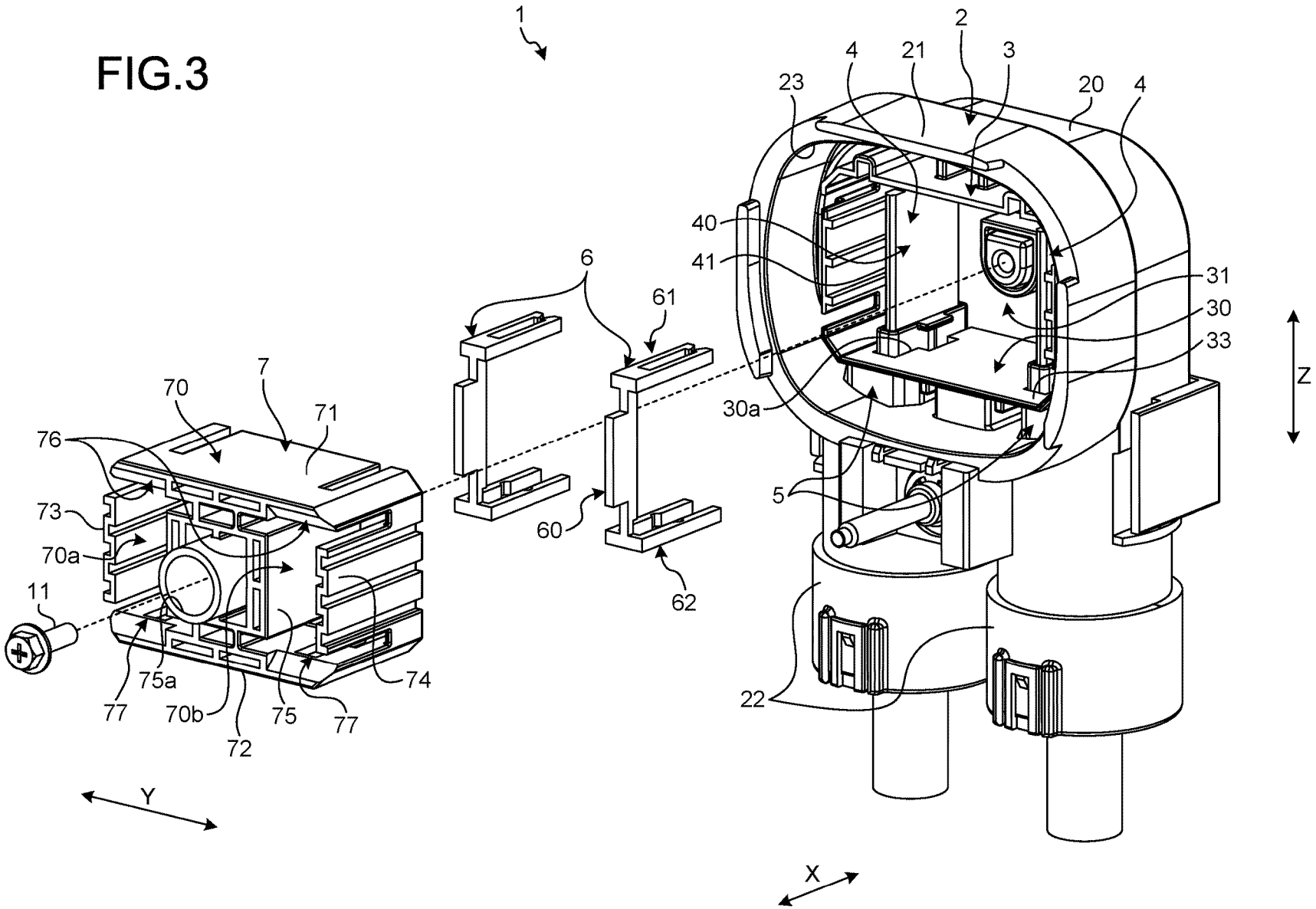
FIG. 3 is an exploded perspective view of the connector according to the embodiment.
Figure 4:
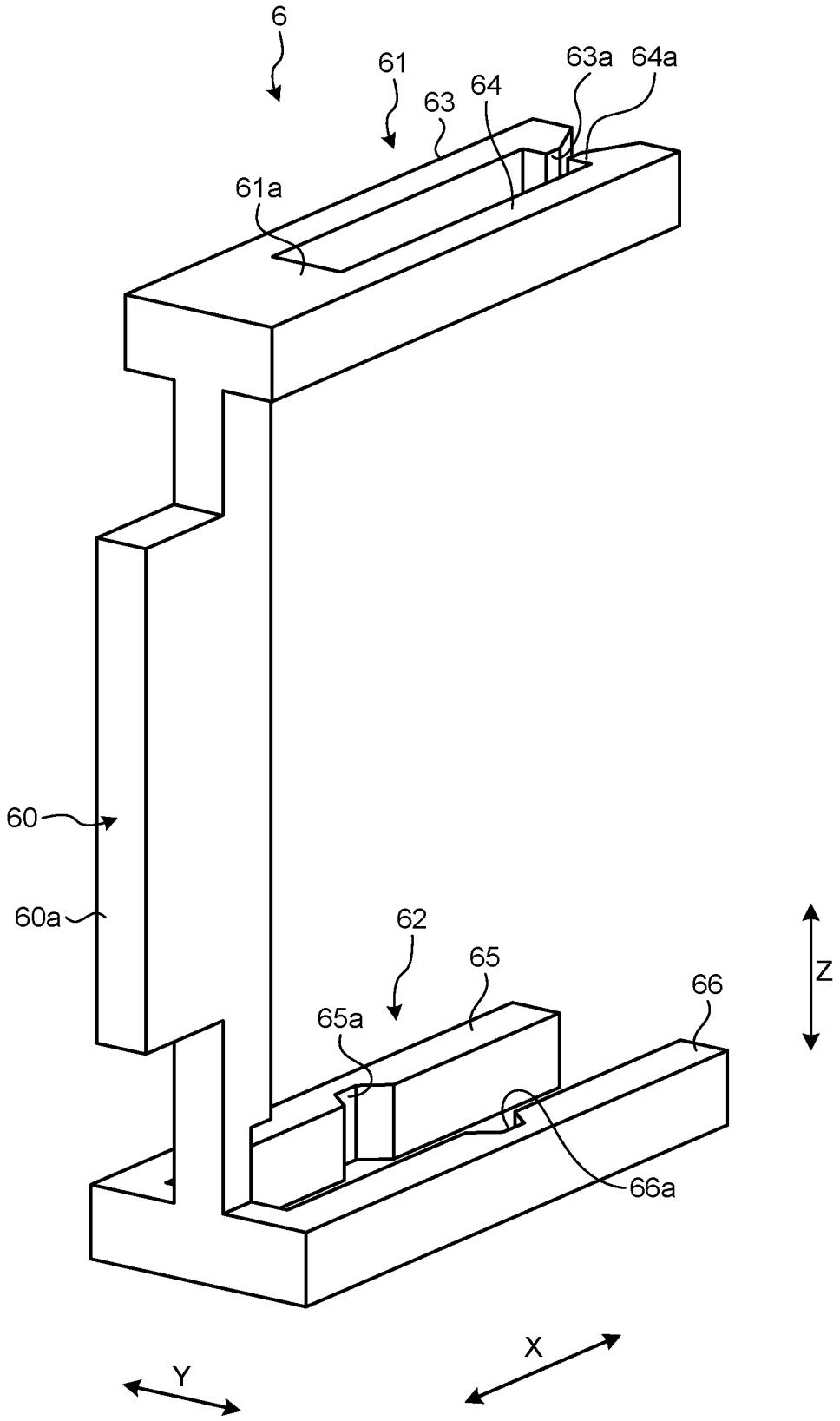
FIG. 4 is a perspective view of a cover member according to the embodiment.
Figure 5:
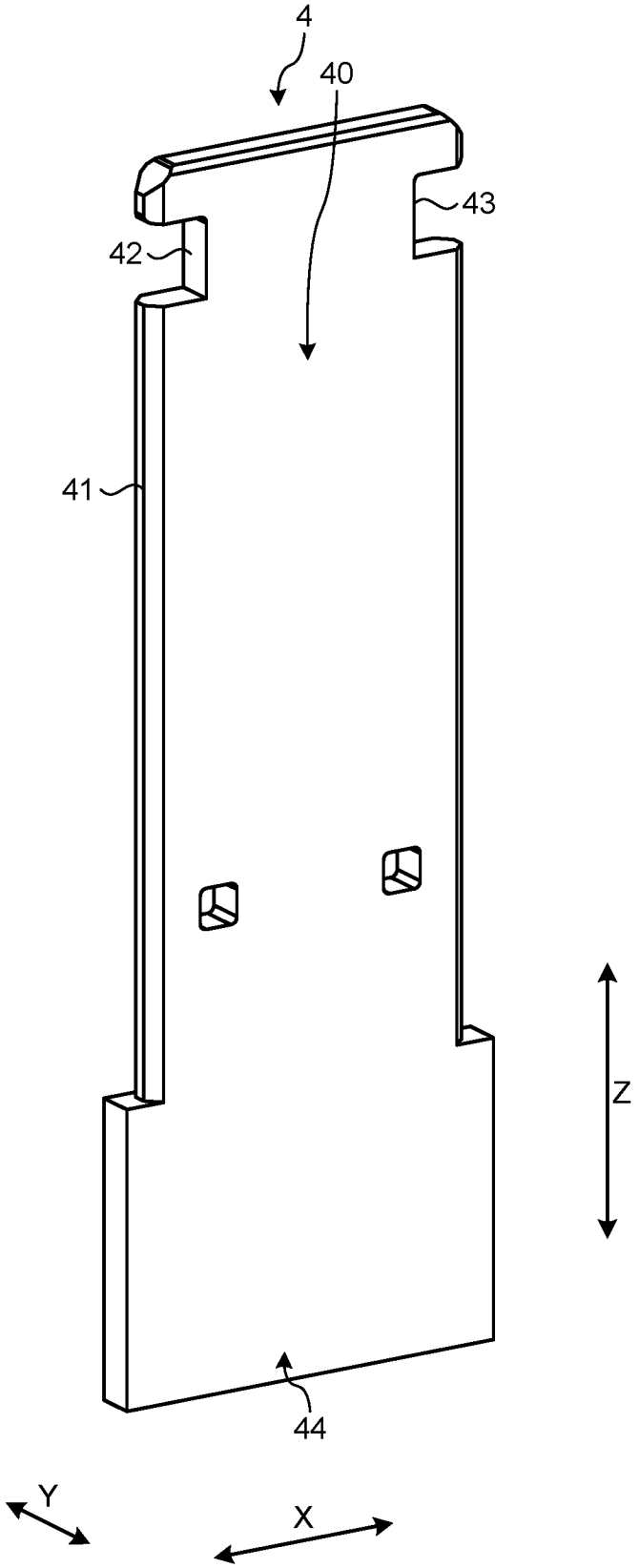
FIG. 5 is a perspective view of a male terminal according to the embodiment.
Figure 6:
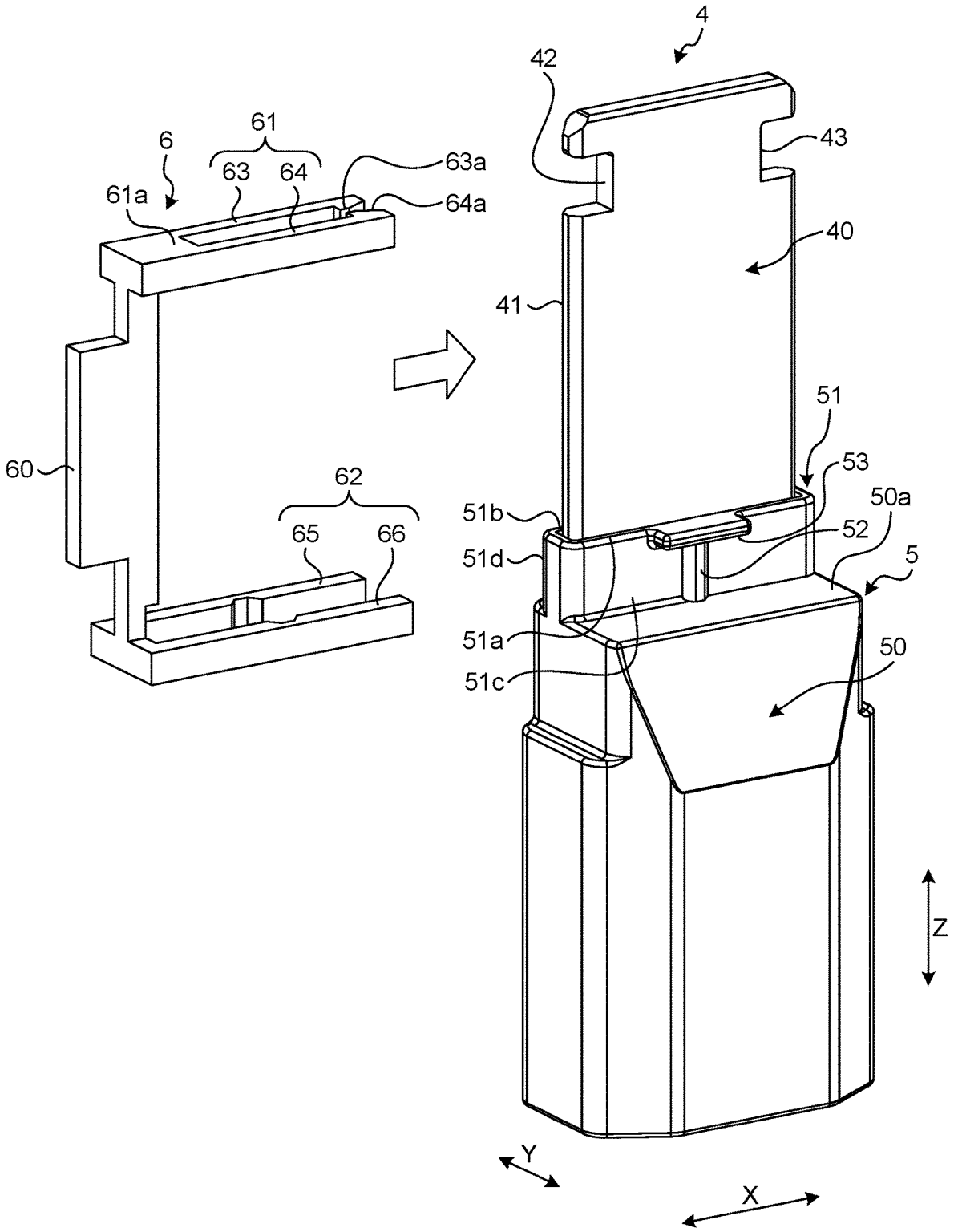
FIG. 6 is a perspective view illustrating assembly of the cover member according to the embodiment.
Figure 7:
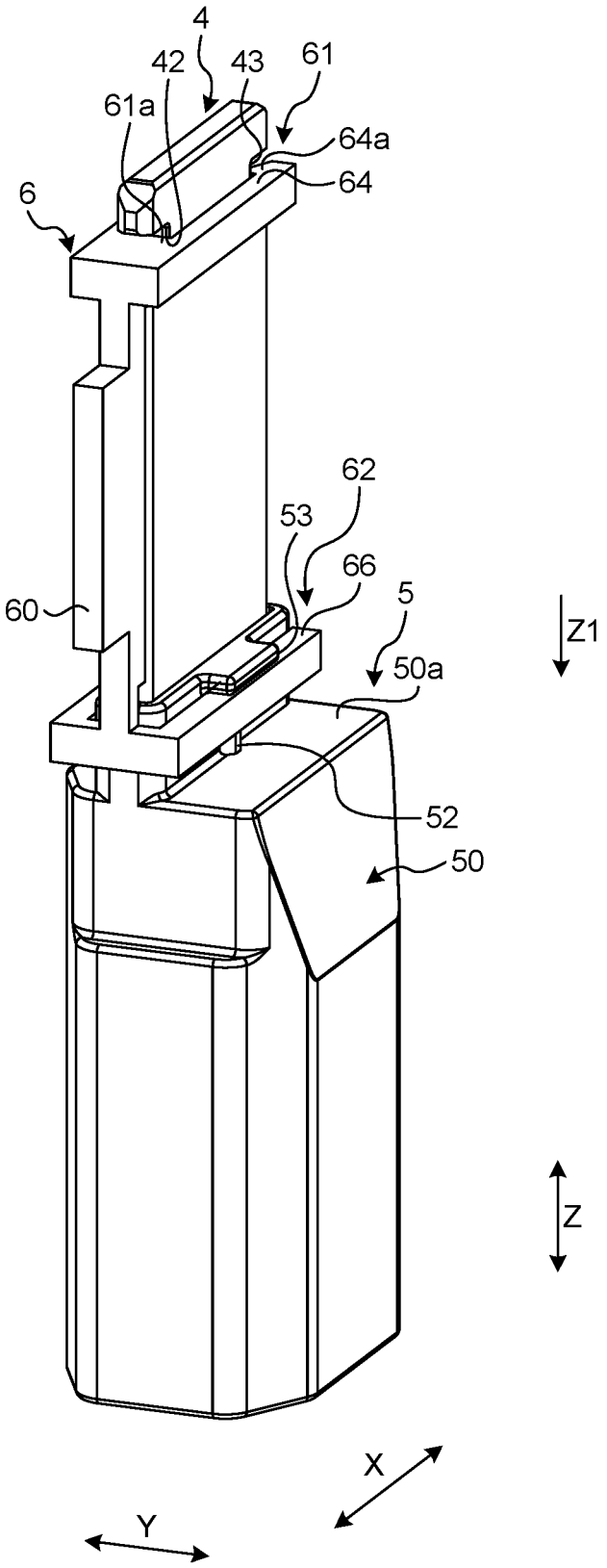
FIG. 7 is a perspective view of the cover member, the male terminal, and an insulating member according to the embodiment.
Figure 8:
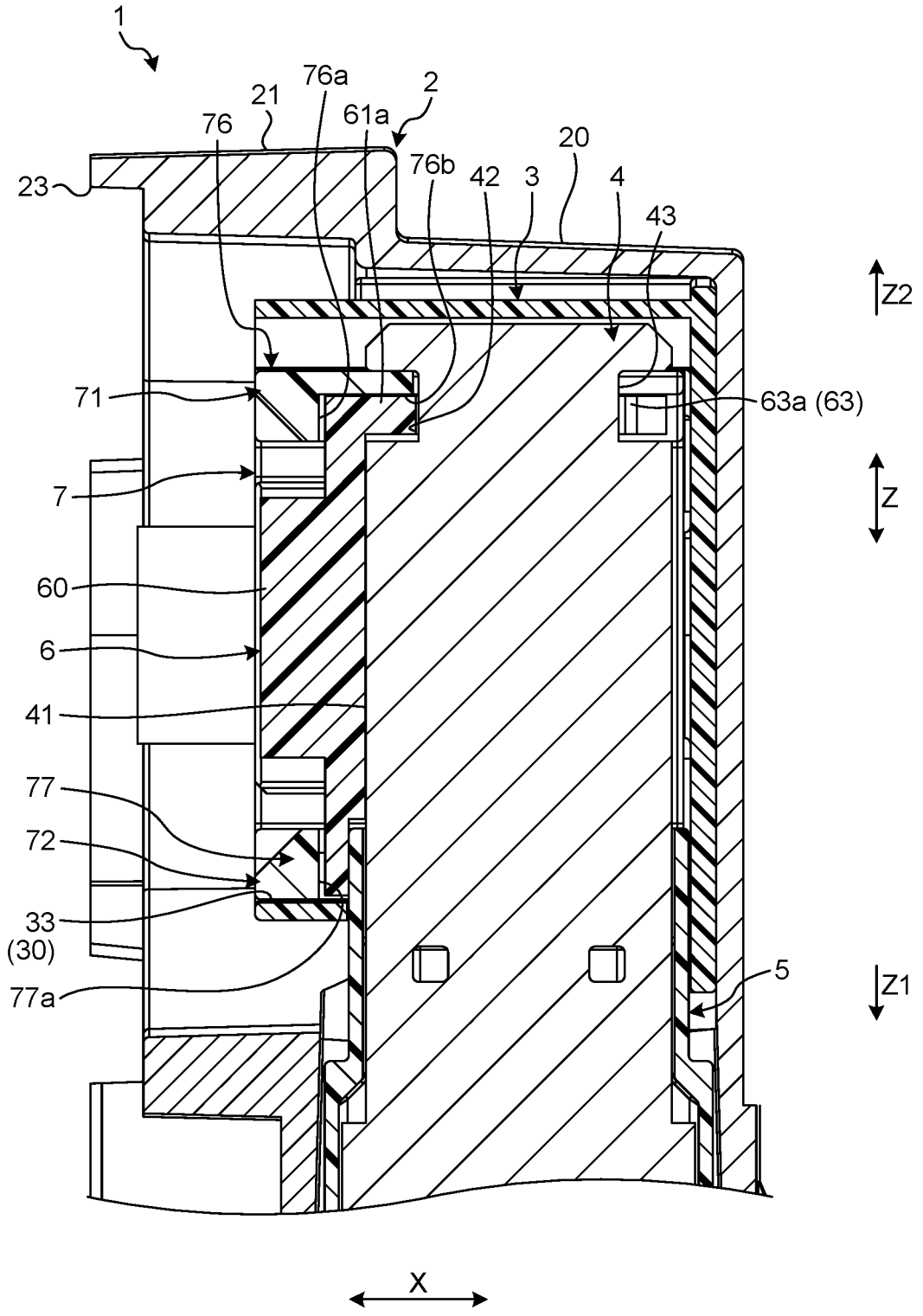
FIG. 8 is a cross-sectional view of the connector according to the embodiment.

The embodiment will be described with reference to FIGS. 1 to 8. The embodiment relates to a connector. FIG. 1 is a perspective view of the connector according to the embodiment, FIG. 2 is a front view of the connector according to the embodiment, FIG. 3 is an exploded perspective view of the connector according to the embodiment, FIG. 4 is a perspective view of a cover member according to the embodiment, FIG. 5 is a perspective view of a male terminal according to the embodiment, FIG. 6 is a perspective view illustrating assembly of the cover member according to the embodiment, FIG. 7 is a perspective view of the cover member, the male terminal, and an insulating member according to the embodiment, and FIG. 8 is a cross-sectional view of the connector according to the embodiment. FIG. 8 illustrates a cross section taken along line VIII-VIII of FIG. 2.

As illustrated in FIG. 1, a connector 1 according to the embodiment has an outer housing 2, an inner housing 3, a male terminal 4, an insulating member 5, a cover member 6, and a holder 7. The outer housing 2 has a main body 20, a fitting portion 21, and cylindrical portions 22. The main body 20, the fitting portion 21, and the cylindrical portions 22 are integrally formed of, for example, a conductive metal. The outer housing 2 functions as a shield member that shields electromagnetic noise. The shape of the main body 20 is a bottomed cylindrical shape. The main body 20 has a housing space for housing the inner housing 3 and the male terminal 4.

The fitting portion 21 is a portion that fits with the mating connector. The shape of the fitting portion 21 of the embodiment is a cylindrical shape. The cross-sectional shape of the fitting portion 21 is a substantially rectangular shape. More specifically, the cross-sectional shape of the fitting portion 21 is a shape in which the sides of the rectangle are curved outward and the four corners are curved in an arc shape. In the following description, the axial direction of the fitting portion 21 is referred to as a "first direction X". An arrangement direction of the male terminal 4 to be described later is referred to as a "second direction Y". The second direction Y is orthogonal to the first direction X. A direction orthogonal to both the first direction X and the second direction Y is referred to as a "third direction Z". The third direction Z is an insertion direction of the male terminal 4 with respect to the outer housing 2. In the description of each member of the connector 1, the first direction X, the second direction Y, and the third direction Z are directions in a state where the members are assembled to constitute the connector 1.

The fitting portion 21 has an opening 23 that is open toward the external space of the outer housing 2. The opening 23 is positioned at one end of the fitting portion 21 in the first direction X. The other end of the opening 23 in the first direction X is connected to the main body 20. The fitting portion 21 fits with the mating connector along the first direction X.

The outer housing 2 of the embodiment has two cylindrical portions 22. The cylindrical portion 22 protrudes from the main body 20 along the third direction Z. That is, the axial direction of the fitting portion 21 and the axial direction of the cylindrical portion 22 are orthogonal to each other. The two cylindrical portions 22 are arranged along the second direction Y. The male terminal 4 is inserted from an opening 22*a* (refer to FIG. 2) at a tip end of the cylindrical portion 22. An electric wire W is connected to the male terminal 4. The electric wire W is a covered electric wire having a core wire and a covering that covers the core wire. The male terminal 4 is electrically connected to the core wire of the electric wire W.

The insulating member 5 is a pipe-shaped member that covers an electrical connection portion between the male terminal 4 and the electric wire W. The insulating member 5 is molded from, for example, an insulating synthetic resin. The insulating member 5 shields the electrical connection portion between the male terminal 4 and the electric wire W against an inner wall surface of the outer housing 2. A tip end portion of the insulating member 5 protrudes from the cylindrical portion 22 into the internal space of the main body 20 of the outer housing 2.

The cover member 6 is an insulating member, and is molded from, for example, a synthetic resin. As illustrated in FIG. 4, the cover member 6 has a main body 60, a first engagement portion 61, and a second engagement portion 62. The main body 60, the first engagement portion 61, and the second engagement portion 62 are integrated. The main body 60 is a plate-shaped component extending along the third direction Z. The main body 60 has a protrusion 60*a* at the central portion thereof in the third direction Z. The protrusion 60*a* protrudes along the first direction X.

The first engagement portion 61 is connected to one end of the main body 60. The second engagement portion 62 is connected to the other end of the main body 60. The first engagement portion 61 and the second engagement portion 62 protrude along the first direction X in a direction opposite to the protrusion 60*a*. The first engagement portion 61 has a base portion 61*a*, a first arm 63, and a second arm 64. The base portion 61*a* protrudes from the main body 60 in the first direction X and the second direction Y. The first arm 63 and the second arm 64 protrude from the base portion 61*a* along the first direction X. The first arm 63 and the second arm 64 face to each other in the second direction Y. The size of a gap between the first arm 63 and the second arm 64 in the second direction Y is a size corresponding to the plate thickness of the male terminal 4. A locking projection 63*a* that protrudes toward the second arm 64 is provided at a tip end of the first arm 63. A locking projection 64*a* that protrudes toward the first arm 63 is provided at a tip end of the second arm 64.

The second engagement portion 62 has a first arm 65 and a second arm 66. The first arm 65 and the second arm 66 face to each other in the second direction Y. The size of a gap between the first arm 65 and the second arm 66 in the second direction Y is a size corresponding to the thickness of an engagement portion 51 (refer to FIG. 6) of the insulating member 5. The first arm 65 has an engagement recess 65*a*. The engagement recess 65*a* is provided on a surface of the first arm 65 facing the second arm 66. The second arm 66 has an engagement recess 66*a* corresponding to the engagement recess 65*a*. The engagement recess 66*a* is provided on a surface of the second arm 66 facing the first arm 65. The engagement recesses 65*a* and 66*a* are grooves extending along the third direction Z.

As illustrated in FIG. 5, the shape of the male terminal 4 is a plate shape. More specifically, the male terminal 4 is a plate-shaped member having a substantially rectangular planar shape. The male terminal 4 is formed of a conductive metal. The male terminal 4 is housed in the outer housing 2 in such a posture that the third direction Z is a longitudinal direction and the first direction X is a width direction. More specifically, the male terminal 4 is inserted into the outer housing 2 so that a first side surface 41 faces the mating connector. The male terminal 4 is held by the holder 7 or the like. The male terminal 4 has a main body 40 and a base portion 44. The base portion 44 is an end portion of the male terminal 4 in the third direction Z. The main body 40 and the base portion 44 are integrated.

The main body 40 is a portion that is electrically connected to the mating terminal. The base portion 44 is a portion that is electrically connected to the core wire of the electric wire W. The width of the base portion 44 is larger than the width of the main body 40. A step surface 44*a* is provided at the boundary between the base portion 44 and the main body 40. Two notches 42 and 43 are provided at a tip end portion of the main body 40. The notches 42 and 43 are provided at edges of the main body 40 in the width direction, respectively. The two notches 42 and 43 are disposed at the same position in the third direction Z.

With reference to FIGS. 6 and 7, attachment of the cover member 6 with respect to the male terminal 4 and the insulating member 5 will be described. For ease of understanding, illustration of members other than the male terminal 4, the insulating member 5, and the cover member 6 is omitted in FIG. 6. As illustrated in FIG. 6, the insulating member 5 has a main body 50 and the engagement portion 51. The main body 50 and the engagement portion 51 are integrally formed. The shapes of the main body 50 and the engagement portion 51 are cylindrical shapes. The main body 50 is a portion that covers an electrical connection portion between the male terminal 4 and the electric wire W.

The engagement portion 51 is connected to one end of the main body 50. The cross-sectional shape of the engagement portion 51 is a shape corresponding to the cross-sectional shape of the main body 40 of the male terminal 4. That is, the cross-sectional shape of the engagement portion 51 is a substantially rectangular shape. A tip end of the engagement portion 51 has two long side portions 51*a* and 51*b*. The long side portions 51*a* and 51*b* extend along the first direction X. The engagement portion 51 surrounds the main body 40 with a slight gap between the engagement portion 51 and the main body 40. The width of the engagement portion 51 in the second direction Y is narrower than the width of the main body 50 in the second direction Y. A step surface 50*a* is formed at the boundary between the main body 50 and the engagement portion 51.

The engagement portion 51 has an engagement projection 52 and a locked portion 53. The locked portion 53 is provided at the edge of the tip end of the engagement portion 51. In the engagement portion 51 of the embodiment, the locked portion 53 is provided to each of the two long side portions 51*a* and 51*b*. The locked portion 53 protrudes along the second direction Y and extends along the first direction X. The shape of the locked portion 53 when viewed from the third direction Z is a rectangular shape. One engagement projection 52 is provided to each of two side surfaces 51*c* and 51*d* of the engagement portion 51. The engagement projection 52 is a rib formed on each of the side surfaces 51*c* and 51*d*, protrudes in the second direction Y, and extends along the third direction Z. The engagement projection 52 of the embodiment extends from the step surface 50*a* up to the locked portion 53.

The cover member 6 is mounted on the male terminal 4 after the male terminal 4 is inserted into the outer housing 2, for example. However, the cover member 6 may be mounted on the male terminal 4 before the male terminal 4 is inserted into the outer housing 2. The cover member 6 of the embodiment is attached to the male terminal 4 and the insulating member 5 while relatively moving along the first direction X, as illustrated in FIG. 6. The male terminal 4 enters between the first arm 63 and the second arm 64 of the first engagement portion 61. The engagement portion 51 of the insulating member 5 enters between the first arm 65 and the second arm 66 of the second engagement portion 62.

The cover member 6 is pushed to a position where the locking projections 63*a* and 64*a* engage with the notch 43 and the engagement projection 52 engages with the engagement recesses 65*a* and 66*a*. The locking projections 63*a* and 64*a* are locked by a wall surface of the notch 43 so that detaching of the cover member 6 from the male terminal 4 is restricted. The base portion 61*a* of the first engagement portion 61 enters the notch 42 of the male terminal 4. The notch 42 locks the base portion 61*a* so that a relative movement of the cover member 6 and the male terminal 4 along the third direction Z is restricted.

The first arm 65 and the second arm 66 of the cover member 6 enter between the locked portion 53 and the step surface 50*a*. The engagement projection 52 of the insulating member 5 engages with the engagement recesses 65*a* and 66*a* of the cover member 6 so that detaching of the cover member 6 from the insulating member 5 is restricted. As illustrated in FIG. 7, the first arm 65 and the second arm 66 are positioned in the vicinity of the locked portion 53 and face the locked portion 53 in the third direction Z. As will be described later, the first arm 65 and the second arm 66 can function as a retaining member of the insulating member 5.

The cover member 6 mounted on the male terminal 4 covers the first side surface 41 of the male terminal 4. As illustrated in FIG. 8, the first side surface 41 is a side surface facing the opening 23 of the outer housing 2 among the two side surfaces of the male terminal 4. In other words, the first side surface 41 is a side surface facing the mating connector when the connector 1 is connected to the mating connector. That is, the cover member 6 covers the first side surface 41 of the male terminal 4, which faces the external space. Therefore, the cover member 6 can suppress that a finger touches the male terminal 4. As illustrated in FIG. 1 or the like, the cover member 6 entirely covers a portion of the first side surface 41, which faces the external space.

The inner housing 3 is a bottomed cylindrical member as illustrated in FIG. 3 or the like. The inner housing 3 has an outer wall portion 30 and a bottom wall portion 31. The shape of the outer wall portion 30 is a rectangular tube shape. The bottom wall portion 31 closes one end of the outer wall portion 30. The inner housing 3 is housed in the outer housing 2 with the bottom wall portion 31 facing the back of the outer housing 2. The outer wall portion 30 has an opening 30*a* into which the male terminal 4 and the insulating member 5 are inserted. The main body 40 of the male terminal 4 is inserted into the inner housing 3 through the opening 30*a*.

The holder 7 is a block-shaped member as illustrated in FIGS. 1 to 3 or the like. The holder 7 is molded from, for example, an insulating synthetic resin. The holder 7 has an outer wall portion 70 and an intermediate wall portion 75. The outer wall portion 70 and the intermediate wall portion 75 are integrated. The outer wall portion 70 is formed in a rectangular tube shape, and has a first side wall 71, a second side wall 72, a third side wall 73, and a fourth side wall 74. The first side wall 71 and the second side wall 72 face to each other in the third direction Z. The third side wall 73 and the fourth side wall 74 face to each other in the second direction Y.

The intermediate wall portion 75 extends along the third direction Z, and connects the first side wall 71 and the second side wall 72. A female terminal of the mating connector is inserted into through-holes 70*a* and 70*b* and connected to the male terminal 4. The through-hole 70*a* is a through-hole penetrating between the intermediate wall portion 75 and the third side wall 73 along the first direction X. The through-hole 70*b* is a through-hole penetrating between the intermediate wall portion 75 and the fourth side wall 74 along the first direction X. The intermediate wall portion 75 has a cylindrical portion 75*a*. A fastening member 11 is inserted into the cylindrical portion 75*a* and screwed into a screw hole of the outer housing 2. The fastening member 11 fixes the holder 7 to the outer housing 2. The holder 7 presses the inner housing 3 against the outer housing 2 to fix the inner housing 3.

The first side wall 71 has two first holding portions 76. The first holding portion 76 is a portion that holds the cover member 6 between the first holding portion 76 and the male terminal 4. The second side wall 72 has two second holding portions 77. The second holding portion 77 is a portion that holds the cover member 6 between the male terminal 4 and the insulating member 5.

As illustrated in FIG. 1, a protrusion 60*a* of the cover member 6 serves as a partition wall that partitions the through-holes 70*a* and 70*b* of the holder 7. For example, one cover member 6 substantially bisects the through-hole 70*a*. That is, the cover member 6 partitions the through-hole 70*a* into two different through-holes having a narrow width. Therefore, the cover member 6 effectively prevents a finger or the like from entering the through-holes 70*a* and 70*b*. Further, the main body 60 of the cover member 6 has the protrusion 60*a* that protrudes toward the opening 23. Therefore, the cover member 6 can prevent fingers from entering to the back of the through-holes 70*a* and 70*b*.

As illustrated in FIG. 8, the first holding portion 76 has a first locking surface 76*a* and a second locking surface 76*b*. The first locking surface 76*a* is a surface that locks the cover member 6 in the first direction X. The first locking surface 76*a* faces the first side surface 41 of the male terminal 4 in the first direction X. The first locking surface 76*a* sandwiches the cover member 6 with the first side surface 41 of the male terminal 4, and holds the cover member 6 in the first direction X.

The second locking surface 76*b* is a surface that locks the cover member 6 in the third direction Z. The second locking surface 76*b* is a surface facing the second side wall 72 in the third direction Z. In other words, the second locking surface 76*b* is a surface facing the internal space of the holder 7 in the first side wall 71. The second locking surface 76*b* locks the base portion 61*a* of the cover member 6 and restricts the movement of the cover member 6 along the third direction Z. The first holding portion 76 of the embodiment has an insertion portion 76*c*. The insertion portion 76*c* is inserted into the notch 42 of the male terminal 4. The insertion portion 76*c* positions the cover member 6 in the third direction Z and restricts the positional deviation of the cover member 6 with respect to the male terminal 4.

The second holding portion 77 has a first locking surface 77*a*. The first locking surface 77*a* is a surface that locks the cover member 6 in the first direction X. The first locking surface 77*a* faces the first side surface 41 of the male terminal 4 in the first direction X. Further, a portion of the first side surface 41, which faces the first locking surface 77*a*, is covered with the insulating member 5. Accordingly, the first locking surface 77*a* faces the first side surface 41 with the insulating member 5 interposed therebetween. The first locking surface 77*a* sandwiches the cover member 6 between the first locking surface 77*a* and the insulating member 5 and holds the cover member 6 in the first direction X.

The outer wall portion 30 of the inner housing 3 has a locking surface 33. The locking surface 33 is a surface that locks the cover member 6 in the third direction Z. The locking surface 33 faces the second locking surface 76*b* of the holder 7 in the third direction Z. In other words, the locking surface 33 is a surface facing the internal space of the inner housing 3 in the outer wall portion 30. The locking surface 33 restricts the movement of the cover member 6 in a pull-out direction Z1. The pull-out direction Z1 is a direction in which the male terminal 4 and the insulating member 5 come out of the outer housing 2 along the third direction Z. In the third direction Z, a direction opposite to the pull-out direction Z1 is referred to as an "insertion direction Z2". The movement of the cover member 6 toward the insertion direction Z2 is restricted by the second locking surface 76*b* of the holder 7.

In this manner, the movement of the cover member 6 of the embodiment is restricted in both the pull-out direction Z1 and the insertion direction Z2. The cover member 6 can restrict the pulling out of the insulating member 5 as described below. As illustrated in FIG. 7, the second engagement portion 62 of the cover member 6 faces the locked portion 53 of the insulating member 5 in the third direction Z. When the insulating member 5 is about to move in the pull-out direction Z1, the second engagement portion 62 locks the locked portion 53 to restrict the movement of the insulating member 5. Therefore, with the connector 1 of the embodiment, the pulling out and backlash of the insulating member 5 and the male terminal 4 are preferably suppressed. Further, as illustrated in FIG. 8, the insertion portion 76*c* of the holder 7 is inserted into the notch 42 of the male terminal 4. When the male terminal 4 is about to move in the pull-out direction Z1, the insertion portion 76*c* locks the notch 42 to restrict the movement of the male terminal 4. In this manner, the connector 1 of the embodiment has a double pull-out prevention structure.

As described above, the connector 1 of the embodiment includes the outer housing 2, the male terminal 4, the cover member 6, and the holder 7. The outer housing 2 is a housing member that has the opening 23 fitting with the mating connector. The male terminal 4 is housed and held in the outer housing 2 with the first side surface 41 facing the opening 23. The male terminal 4 is a plate-shaped terminal held by the insulating member 5, the inner housing 3, the cover member 6, the fastening member 11, and the like.

The cover member 6 is an insulating member that is mounted on the male terminal 4 and covers the first side surface 41. The holder 7 is a member having through-holes 70*a* and 70*b* into which the female terminal is inserted. The holder 7 is attached to the outer housing 2 from the opening 23 side and locks the cover member 6. With the connector 1 of the embodiment, the cover member 6 is locked by the holder 7. Therefore, the positional deviation and falling-off of the cover member 6 are suppressed, and contact of a finger with respect to the male terminal 4 is more reliably prevented. Further, a common holder 7 can be used for the male terminals 4 having different shapes. The cover members 6 having corresponding shapes are used for the male terminals 4 having different shapes. If the shapes of the portions locked by the holder 7 in the different cover members 6 are made common, the holder 7 is made common.

In the connector 1 of the embodiment, the first side surface 41 of the male terminal 4 is covered with the dedicated cover member 6. Therefore, the exposure of the first side surface 41 due to the deviation of the attachment position is difficult to occur. As a comparative example, a configuration in which a portion corresponding to the cover member 6 is provided to the holder 7 is considered. In the case of the comparative example, the holder 7 and the male terminal 4 are separately attached to the outer housing 2. As a result, variation in alignment of the first side surface 41 and the portion covering the first side surface 41 is likely to occur. On the other hand, since the cover member 6 of the embodiment is mounted on the male terminal 4, it is easy to ensure the alignment accuracy. Moreover, in the connector 1 of the embodiment, the configuration of the holder 7 is simplified with respect to the comparative example.

In the connector 1 of the embodiment, the holder 7 has the first holding portion 76 and the second holding portion 77 that hold the cover member 6. Since the cover member 6 is held by the first holding portion 76 and the second holding portion 77, the positional deviation and falling-off of the cover member 6 are more reliably suppressed.

The holder 7 of the embodiment has the first locking surface 76*a* and the first locking surface 77*a* which face the first side surface 41 of the male terminal 4 and lock the cover member 6. The first locking surface 76*a* and the first locking surface 77*a* can suitably prevent the cover member 6 from falling off from the first side surface 41.

The holder 7 of the embodiment has the second locking surface 76*b* that locks the cover member 6 in the longitudinal direction of the male terminal 4. The second locking surface 76*b* can suppress the positional deviation of the cover member 6 in the longitudinal direction of the male terminal 4, and can suppress the exposure of the first side surface 41.

First Modification of Embodiment

Figure 9:
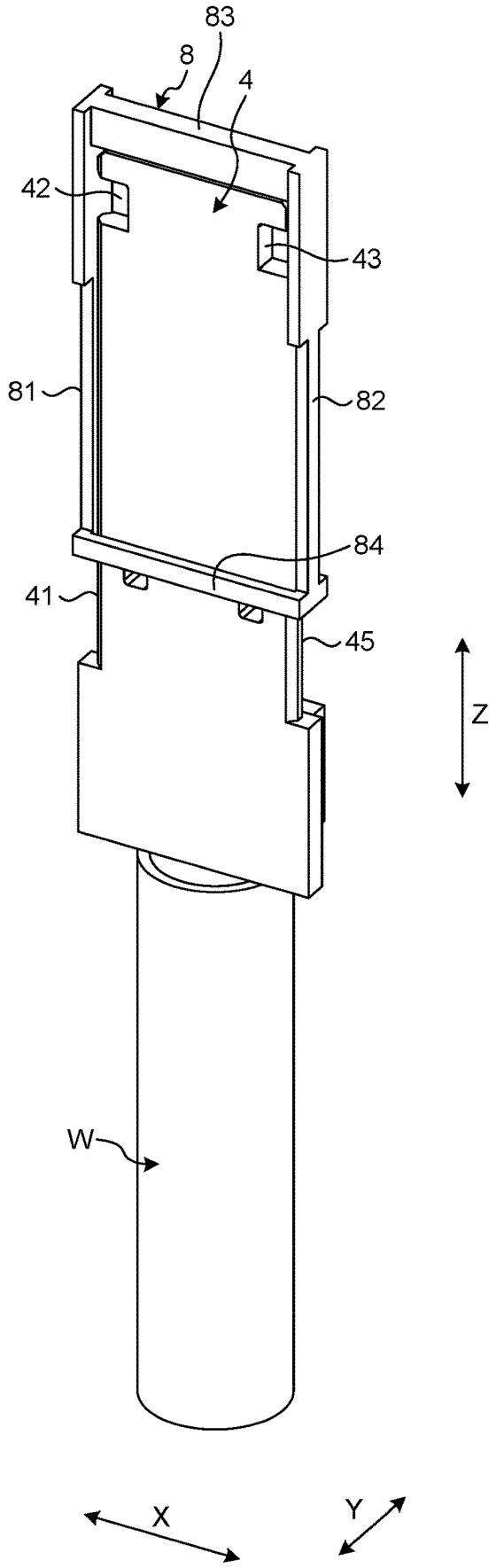
FIG. 9 is a perspective view of a male terminal and a cover member according to a first modification of the embodiment.
Figure 10:
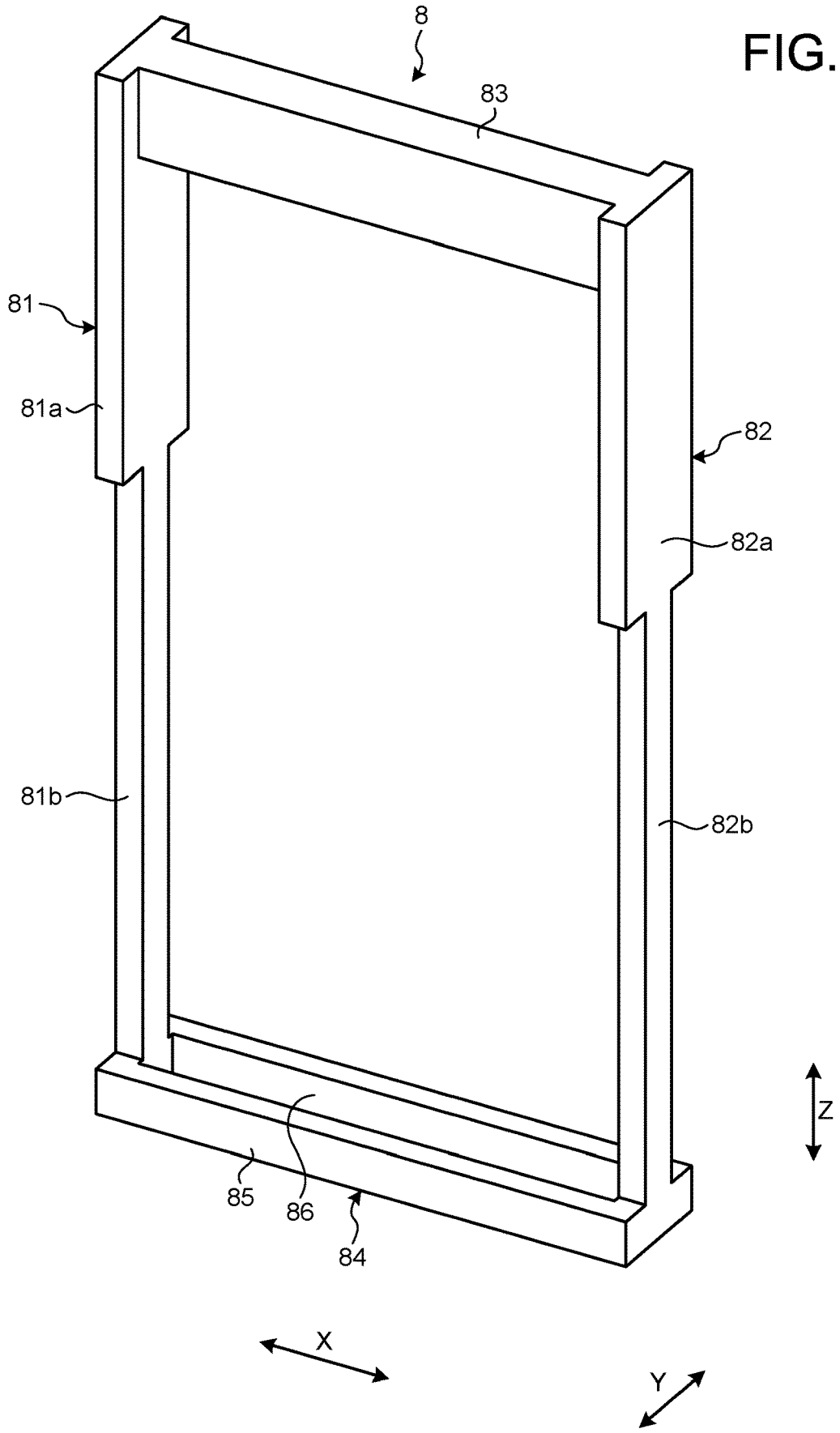
FIG. 10 is a perspective view of the cover member according to the first modification of the embodiment.

A first modification of the embodiment will be described. FIG. 9 is a perspective view of a male terminal and a cover member according to the first modification of the embodiment, and FIG. 10 is a perspective view of the cover member according to the first modification of the embodiment. In the first modification of the embodiment, a point different from the above embodiment is, for example, that the male terminal 4 is inserted into a cover member 8.

As illustrated in FIGS. 9 and 10, the cover member 8 according to the first modification of the embodiment is formed in a rectangular frame shape as a whole. The cover member 8 has a first columnar portion 81, a second columnar portion 82, a third columnar portion 83, and a fourth columnar portion 84. The first columnar portion 81, the second columnar portion 82, the third columnar portion 83, and the fourth columnar portion 84 are integrally molded from an insulating synthetic resin or the like. The first columnar portion 81 and the second columnar portion 82 face each other in the first direction X. The third columnar portion 83 and the fourth columnar portion 84 face each other in the third direction Z.

The first columnar portion 81 has a wide portion 81*a* and a narrow portion 81*b*. The width of the narrow portion 81*b* in the second direction Y corresponds to the plate thickness of the male terminal 4. In the second direction Y, the width of the wide portion 81*a* is wider than the width of the narrow portion 81*b*. The second columnar portion 82 is formed in the same manner as the first columnar portion 81, and has a wide portion 82*a* and a narrow portion 82*b*. The narrow portions 81*b* and 82*b* are provided at a portion where the female terminal passes.

The third columnar portion 83 extends along the first direction X, and connects the wide portion 81*a* of the first columnar portion 81 and the wide portion 82*a* of the second columnar portion 82. The fourth columnar portion 84 extends along the first direction X, and connects the narrow portion 81*b* of the first columnar portion 81 and the narrow portion 82*b* of the second columnar portion 82. The fourth columnar portion 84 has a pair of column portions 85 and 86. The pair of column portions 85 and 86 is disposed with a gap in the second direction Y. In other words, the fourth columnar portion 84 has a slit-shaped through-hole extending along the first direction X. The fourth columnar portion 84 is formed such that the male terminal 4 can be inserted between the pair of column portions 85 and 86.

When the cover member 8 is mounted on the male terminal 4, the male terminal 4 is inserted from the tip end to a space between the pair of column portions 85 and 86. As illustrated in FIG. 9, the first columnar portion 81 covers the first side surface 41 of the male terminal 4. The second columnar portion 82 covers a second side surface 45 of the male terminal 4. The third columnar portion 83 covers a side surface on the tip end of the male terminal 4. In this manner, the cover member 8 of the first modification can cover the male terminal 4 from three directions. Therefore, the cover member 8 of the modification can be applied to not only the connector 1 in which the male terminal 4 is housed with the first side surface 41 facing the opening 23, but also the connector 1 in which the male terminal 4 is housed with the second side surface 45 or the side surface on the tip end facing the opening 23.

The cover member 8 may have engagement projections that engage with the notches 42 and 43 of the male terminal 4. The male terminal 4 is inserted into the outer housing 2 after the cover member 8 is mounted, for example. Illustration of the insulating member 5 is omitted in FIGS. 9 and 10. The cover member 8 is mounted on the male terminal 4 after the insulating member 5 is attached to the male terminal 4, for example.

The cover member 8 according to the first modification of the embodiment does not easily fall off from the terminal 4. Therefore, the cover member 8 of the first modification can more reliably suppress the contact of a finger with respect to the male terminal 4.

Second Modification of Embodiment

The shapes of the cover members 6 and 8 and the holder 7 are not limited to the shapes exemplified in the embodiment and the first modification. For example, in the cover member 6 of the above-described embodiment, both the first engagement portion 61 and the second engagement portion 62 may engage with the male terminal 4. The holder 7 of the above-described embodiment may lock the cover member 6 from both sides in the third direction Z. In this case, the second holding portion 77 (refer to FIG. 8) of the holder 7 has a second locking surface that locks the cover member 6, in place of the locking surface 33 of the inner housing 3. The second locking surface of the second holding portion 77 locks the cover member 6 in the same manner as the locking surface 33 of the inner housing 3.

The number of male terminals 4 included in the connector 1 is not limited to two. The number of male terminals 4 included in the connector 1 may be one or three or more. The terminal included in the connector 1 is not limited to the male terminal 4 and may be a female terminal. The cover members 6 and 8 may be mounted on the female terminal. The connector 1 may not be a so-called shield connector. In other words, the cover members 6 and 8 can be applied to a terminal of a connector other than the shield connector. The material of the holder 7 may be different from the material of the cover members 6 and 8. For example, the cover members 6 and 8 may be formed of a material having a higher heatproof temperature than that of the holder 7.

The contents disclosed in the above-described embodiment and modification can be executed in appropriate combinations.

A connector according to the embodiment includes a housing that has an opening fitting with a mating connector, a plate-shaped terminal that is housed and held in the housing with a first side surface facing the opening, an insulating cover member that is mounted on the terminal and covers the first side surface, and a holder that has through-holes into which mating terminals as terminals of the mating connector are inserted, is attached to the housing from the opening side, and locks the cover member. With the connector according to the embodiment, the cover member is locked by the holder. Therefore, the connector according to the embodiment has an effect of restricting the positional deviation of the cover member with respect to the terminal and appropriately suppressing contact of a finger with respect to the terminal.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a housing that has an opening fitting with a mating connector;

a plate-shaped terminal that is inserted from a direction orthogonal to a direction of the opening of the housing and housed and held in the housing with a first side surface of the terminal facing the opening;

an insulating cover member that is mounted on the terminal and covers the first side surface; and a holder that has through-holes into which mating terminals as terminals of the mating connector are inserted, is attached to the housing from the opening side, and locks the cover member, and the holder extends into the opening of the housing along the direction of the opening.

2. The connector according to claim 1, wherein the holder has a holding portion that holds the cover member.

3. The connector according to claim 1, wherein the holder has a first locking surface that faces the first side surface and locks the cover member.

4. The connector according to claim 2, wherein the holder has a first locking surface that faces the first side surface and locks the cover member.

5. The connector according to claim 1, wherein the holder has a second locking surface that locks the cover member in a longitudinal direction of the terminal.

6. The connector according to claim 2, wherein the holder has a second locking surface that locks the cover member in a longitudinal direction of the terminal.

7. The connector according to claim 3, wherein the holder has a second locking surface that locks the cover member in a longitudinal direction of the terminal.

8. The connector according to claim 4, wherein the holder has a second locking surface that locks the cover member in a longitudinal direction of the terminal.

* * * * *